United States Patent [19]

Murayama et al.

[11] Patent Number: 4,690,625

[45] Date of Patent: Sep. 1, 1987

[54] SCROLL-TYPE FLUID MACHINE WITH CONFIGURED WRAP EDGES AND GROOVES

[75] Inventors: Akira Murayama; Hiroaki Kuno; Naoshi Uchikawa; Takahiro Tamura; Takao Mizuno; Kazumi Aiba; Mitsuo Ikeda; Kiyoshi Fukatsu, all of Shimizu, Japan

[73] Assignee: Hitachi, Ltd., Tokyo, Japan

[21] Appl. No.: 813,719

[22] Filed: Dec. 27, 1985

[30] Foreign Application Priority Data

Jan. 9, 1985 [JP] Japan ..... 60-848

[51] Int. Cl.[4] ..... F01C 1/04; F01C 21/08

[52] U.S. Cl. ..... 418/55; 29/156.4 R

[58] Field of Search ..... 418/55; 29/156.4 R

[56] References Cited

U.S. PATENT DOCUMENTS 4,464,100 8/1984 Machida et al. ..... 418/55

4,550,480 11/1985 Tanikawa et al. ..... 29/156.4 R

FOREIGN PATENT DOCUMENTS 813559 3/1937 France ..... 418/55

57-148085 9/1982 Japan ..... 418/55

*Primary Examiner*—John J. Vrablik

*Attorney, Agent, or Firm*—Antonelli, Terry & Wands

[57] ABSTRACT

A scroll-type fluid machine includes an orbiting scroll member and a stationary scroll member each of which has an end plate and a spiral wrap protruding upright therefrom. The scroll members are assembled together such that their wraps mesh with each other. Closed spaces are defined by the wraps and end plates of both scroll members, and are progressively moved towards the center of the scroll members while decreasing their volumes in accordance with an orbiting movement of the orbiting scroll member. The edges of the projecting end of the wrap of each scroll member are chamfered. Also, steps are formed in conformity with the configuration of each spiral wrap on respective corners of the groove bottom between adjacent turns of the wrap. The chamfered edges of the projecting end of the wrap of each scroll member faces the steps on the groove bottom of the opposing scroll member, respectively, when the scroll members are assembled together.

3 Claims, 11 Drawing Figures

SCROLL-TYPE FLUID MACHINE WITH CONFIGURED WRAP EDGES AND GROOVES

BACKGROUND OF THE INVENTION

The present invention relates to a scroll-type fluid machine and, more particularly, to a scroll member which ensures a higher precision of machining of the spiral wrap on the scroll member.

Various contours of a wrap for scroll members have been proposed, and a typical example is a spiral contour as proposed in U.S. Pat. No. 4,464,100. The design of this wrap, as well as other known wraps having spiral forms, does not take into account the machinability of the side surfaces of the wrap and the surface of the groove between adjacent turns of the warp, i.e., the surface of the end plate of the scroll member.

In general, the spiral wrap is formed along an involute curve or a combination of an involute curve and other curves such as arcs.

It is true that the wrap side surfaces and the groove bottom surface of the same scroll member can be simultaneously machined. Such a machining method, however, is impractical in that the dimensional precision of the wrap is adversely affected by, for example, wear of the machining tool. It has been determined that it is more practical in view of the wear of machine tools and so forth to machine the wrap side surfaces and the groove bottom surface independently and separately.

The contour of the wrap is determined in consideration of both the function of the wrap and easiness of machining of the same. However, the contour of the wrap side surfaces has been the first consideration in fact and then the contour of the groove bottom surface has been determined in conformity with the contour defined between adjacent turns of the wrap. This inevitably requires the machine tool to be moved a long distance along a complicated path, resulting in a long machining time. Additionally, it is not possible to machine the entire portion of the groove bottom surface in one machining cycle, because an unmachined portion remains such as for example, the starting end region of the wrap. Consequently, the precision is adversely affected due to a duplicated machining of the same surface.

SUMMARY OF THE INVENTION

Accordingly, an object of the invention is to provide a scroll-type fluid machine in which the contour of the wrap side surfaces and the contour of the groove bottom surface are determined independently of each other so as to simplify the machining work, thereby improving the machining precision and operation stability.

To this end, according to the invention, there is provided a scroll-type fluid machine comprising an orbiting scroll member, and a stationary scroll member each having an end plate and a spiral wrap protruding upright therefrom, with the scroll members being assembled together with their wraps meshing each other. The orbiting scroll member executes an orbiting motion so that closed spaces defined by the wraps and end plates of both scroll members are progressively moved toward the center thereof while decreasing their volumes in accordance with the orbiting movement of the orbiting scroll member. Edges of the projecting end of the wrap of each scroll member are chamfered, and steps are formed in conformity with a configuration of each spiral wrap on respective corners of a groove bottom between adjacent turns of the wrap with the chamfered edges of the projecting end of the wrap of each scroll member facing the steps on the groove bottom of the opposing scroll member, respectively.

According to this arrangement, since the contour of the wrap side surfaces and that of the groove bottom surface are independently determined, the machining of these surfaces are facilitated and the contours can be optimized for the functions of these surfaces. Thus, only the necessary machining is effected for each of the wrap side surfaces and the groove bottom surface.

Figure 2A:
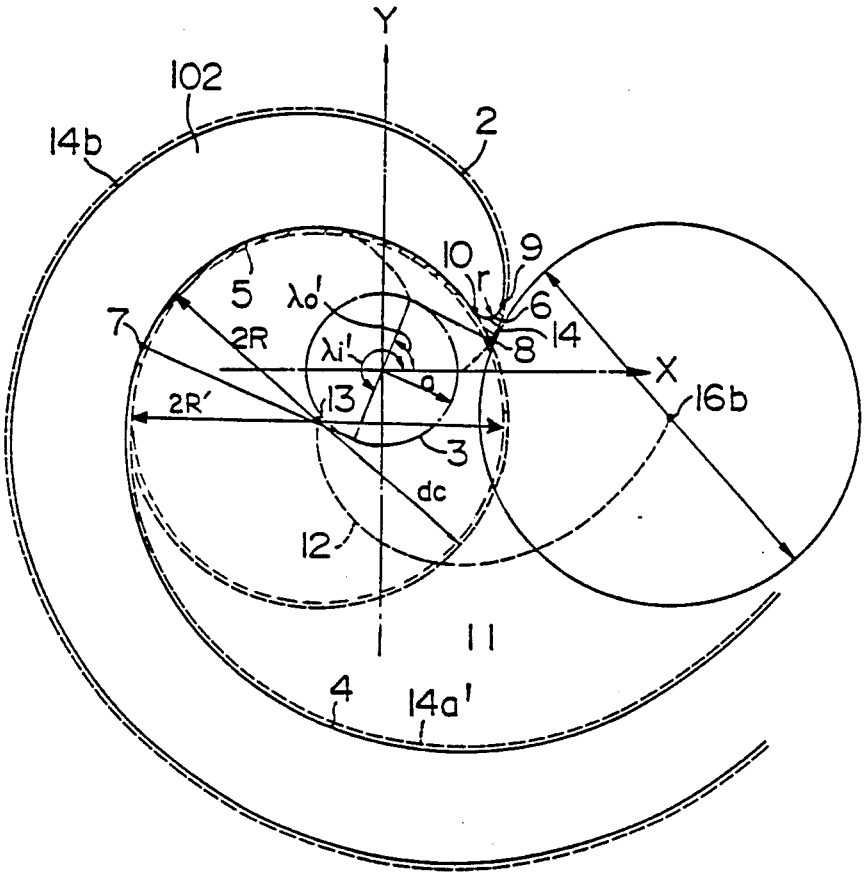
FIG. 2A is an enlarged fragmentary plan view of the wrap of the orbiting scroll member of FIG. 1.
Figure 2B:
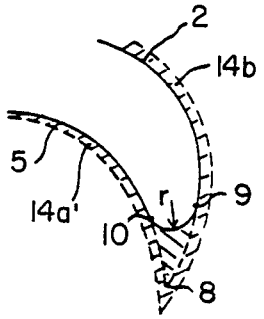
FIG. 2B is an enlarged detail view of a portion of FIG. *2a;*
Figure 2C:
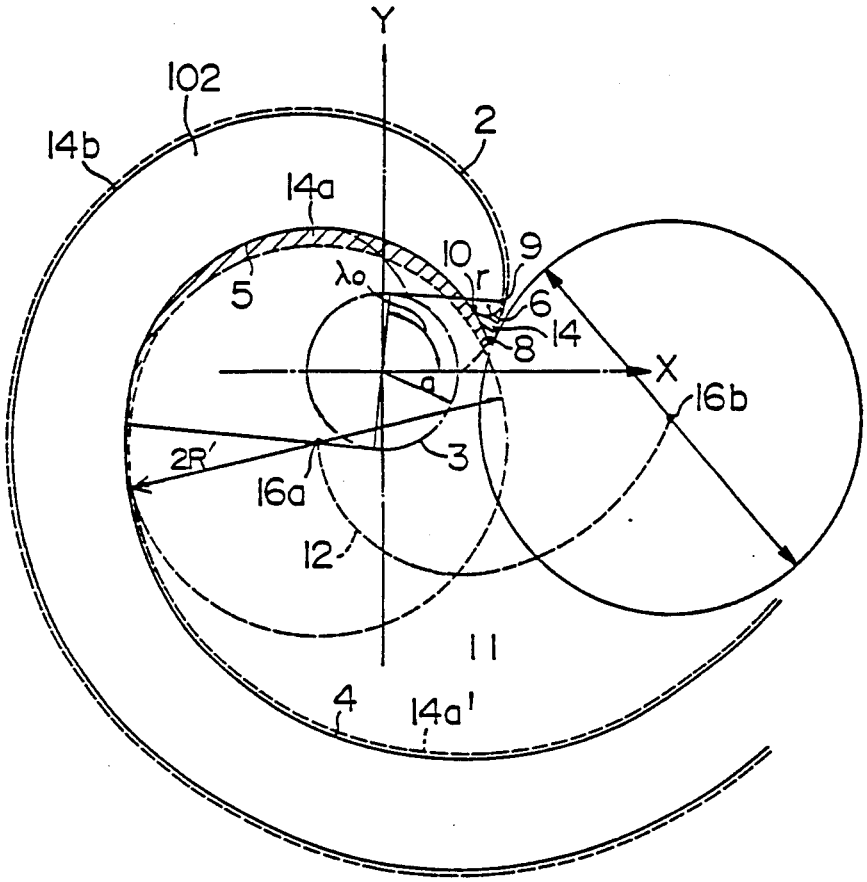

FIG. *2c* is a partial cross-sectional view showing a portion of another embodiment constructed in accordance with the present invention; and FIG. *2d* is an enlarged detail view of a portion of FIG. 2C.

Figure 1:
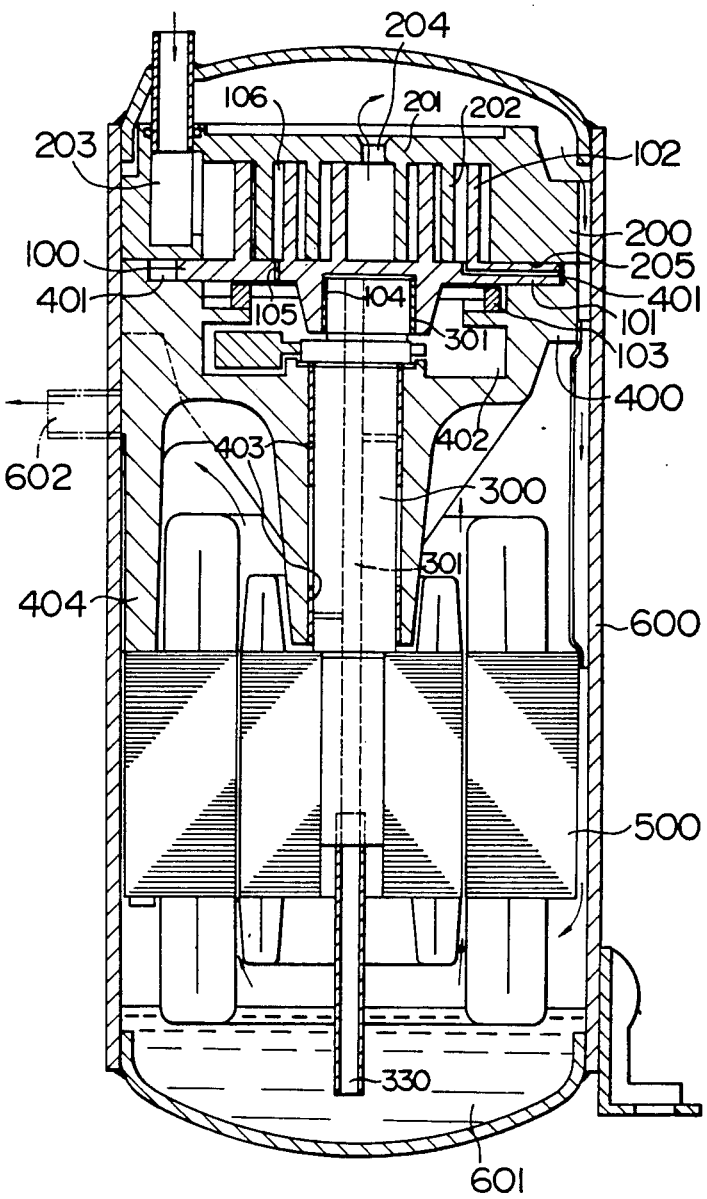
FIG. 1 is a sectional view of the whole portion of a scroll-type fluid machine incorporated with scroll members according to the invention.
Figure 3:
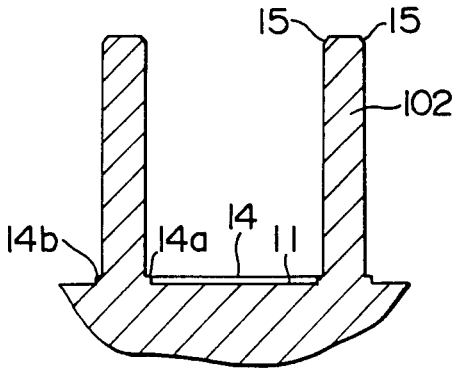
Figure 4:
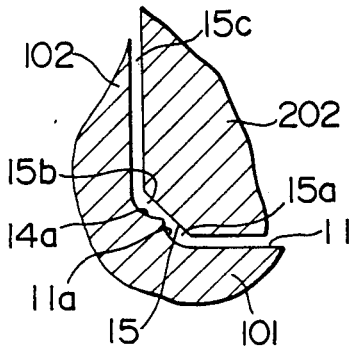
Figure 5:
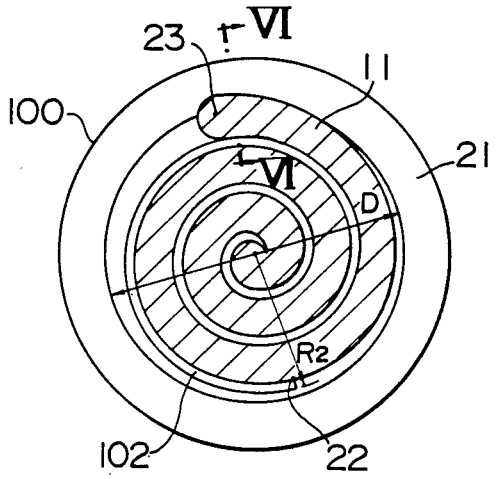
Figure 6:
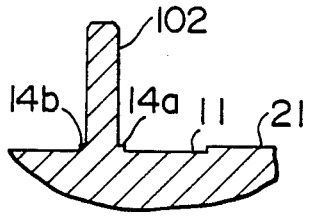
Figure 7:
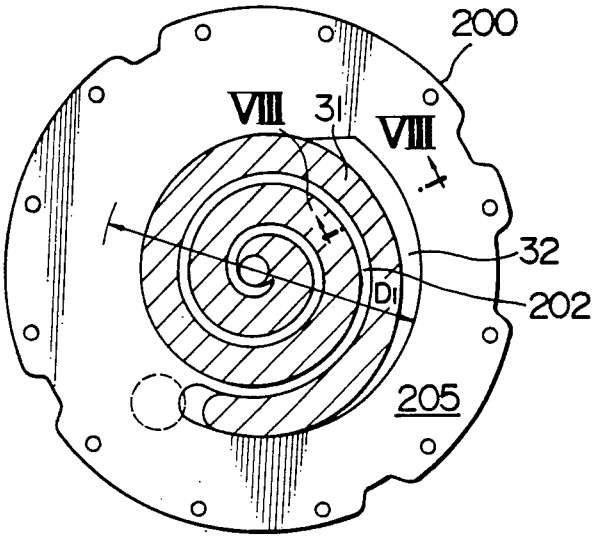
Figure 8:
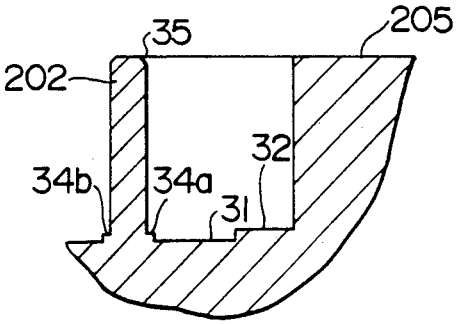

FIG. 3 is a sectional view showing a portion of the scroll member of FIG. 2A between adjacent turns of its scroll wrap;

FIG. 4 is an enlarged fragmentary sectional view showing the scroll wraps of both scroll members of FIG. 1 in the state of meshing with each other;

FIG. 5 is a plan view of the orbiting scroll member according to the invention;

FIG. 6 is an enlarged sectional view taken along the line VI—VI of FIG. 5;

FIG. 7 is a plan view of the stationary scroll member according to the invention; and FIG. 8 is an enlarged sectional view taken along the line VIII—VIII of FIG. 7.

DESCRIPTION OF THE PREFERRED EMBODIMENTS

Referring now to the drawings wherein like reference numerals are used throughout the various views to designate like parts and, more particularly, to FIG. 1, according to this figure, a hermetic type scroll compressor includes an orbiting scroll member 100 and a stationary scroll member 200 with the orbiting scroll member 100 being adapted to make an orbiting movement with respect to the stationary scroll member 200, as it is driven by a crankshaft 300 supported by a frame 400. The scroll members 100, 200, crankshaft 300 and the frame 400 in combination constitute a compression mechanism. The compressor also has a motor 500 for driving the compression mechanism, and the compression mechanism and the motor 500 are housed in a hermetic vessel 600.

The orbiting scroll member 100 has a base or end plate 101 on which is formed a spiral wrap 102. The orbiting scroll member also is provided on the back side thereof with a mechanism 103 for preventing the member 100 from rotating about its own axis, as well as a bearing 104.

Similarly, the stationary scroll member 200 has a base or end plate 201 and a spiral wrap 202 formed on the end plate 201. The stationary scroll member 200 is provided with a suction port 203 and a discharge port 204.

Both scroll members 100 and 200 are assembled together such that the wraps 102, 202 of these scroll members mesh with each other.

The frame 400 has a recess 401 which provides a space for permitting the end plate 101 of the orbiting scroll member 100 to make an orbiting movement therein. The stationary scroll member 200 is fastened to the frame 400 by bolts (not shown), with the end plate 101 of the orbiting scroll member 100 received in the recess 401 such that the orbiting scroll member 100 is movably held between the stationary scroll member 200 and the frame 400. The frame 400 provides a back-pressure chamber 402 on the back side of the orbiting scroll member 100, with the back-pressure chamber 402 communicating through an pressure equalizing port 105 formed in the end plate 101 of the orbiting scroll member 100 with one space of a compression chamber 106 defined by the wraps 102, 202 and end plates 101, 201 of the orbiting and stationary scroll members 100, 200. The frame 400 further has a bearing 403 for rotatably supporting the crankshaft 300 and legs 404 for supporting the motor 500.

An oil passage bore 301 is formed in the crankshaft 300. The oil passage bore 301 is connected to an oil pipe 330 which is immersed at its bottom in an oil well or reservoir formed in the bottom of the hermetic vessel 600, so that a lubricating oil 601 in the oil well is drawn up through the oil pipe 330 and the oil passage bore 301 and supplied to the orbiting bearing 104 and the bearing 403 supporting the crankshaft 300.

In operation, the orbiting scroll member 100 is driven through the crankshaft 300 by the motor 500 so as to make an orbiting movement with respect to the stationary scroll member 200. Meanwhile, the orbiting scroll member 100 is prevented from rotating about its own axis by virtue of the mechanism 103. Consequently, the spaces of the compression chamber 106 formed by the wraps and end plates of both scroll members are progressively moved towards the center of the scroll member while gradually decreasing their volumes, so that a gas sucked from the suction port 203 is compressed and discharged from the discharge port 204. The gas discharged from the discharge port flows in the hermetic vessel 600 as indicated by arrows in FIG. 1 and is sent under pressure to an external device such as a condenser through a discharge pipe 602. During the compressing operation of the compressor, a force is generated by the compressed gas such as to move both scroll members 100, 200 apart from each other. In order to prevent both scroll members 100, 200 from moving apart, an intermediate pressure which is higher than the suction pressure and lower than the discharge pressure is introduced into the back pressure chamber 402, so as to produce a force which serves to press the orbiting scroll member 100 onto the stationary scroll member 200.

The oil which has been supplied through the oil passage bore 301 in the crankshaft 300 to the orbiting bearing 104 and the bearing 403 flows into the backpressure chamber 402 of the intermediate pressure lower than the discharge pressure. The oil then flows through the pressure equalizing port 105 into the compression chamber 106.

The orbiting scroll member 100 performs an orbiting motion at a radius corresponding to the eccentricity of a crank pin 310 of the crankshaft. Portions of the wrap 102 of the orbiting scroll member 100, which are on the same side of the center as the eccentricity of the crank pin 310 of the crankshaft 300, approach the radially inner side surface of the wrap 202 of the stationary scroll member 200, whereas, portions of the wrap 102 on the opposite side of the center to the direction of eccentricity of the crank pin 310 of the crankshaft 300 approach the radially outer side surface of the wrap 202 of the stationary scroll member 200, so that a plurality of the compression spaces are simultaneously formed between the wraps of both scroll members.

Each space of the compression chamber 106 is defined by the wraps 102, 202 and the end plates 101, 201 of the orbiting and stationary scroll members 100, 200. Therefore, the rate of leakage of the gas from each compression space is dependent on the axial gaps between the axial end surfaces of the wraps 102, 202 and the opposing surfaces of the end plates 101, 201, as well as the radial gaps between the side surfaces of the wrap portions coming close to each other. Namely, when the axial gaps between the axial end surfaces of the wraps 102, 202 and the opposing surfaces of the end plates 101, 201 are large, the gas compressed in each compression space undesirably leaks into another compression space of lower pressure, so that the compression performance of the compressor is undesirably impaired. Similarly, when the radial gaps between the adjacent portions of both wraps 102, 202 are large, the gas undesirably leaks into another compression space of the lower pressure, so that the compression performance is impaired.

Minute gaps are formed between the side surfaces of the adjacent portions of both wraps 102, 202, as well as between the axial end surfaces of the wraps 102, 202 and the surfaces of the end plates 101, 201. FIG. 1 shows these minute gaps in an exaggerated manner. When the axial end surface of one of the wraps 102 or 202 contacts the corner of the side surface of the other wrap 102 or 202, the above-mentioned one of the wraps 102, 202 is locally loaded and other gaps, e.g., the gaps between the wraps and end plates 101, 201 and the gaps between the side surfaces of the two wraps 102, 202 are increased to impair the performance and the reliability of the compressor.

It is quite difficult to precisely machine the corners between the side surfaces of the wraps 102, 202 and the end plates 101, 201, so that dimensional errors are often experienced to cause the problems described above.

As shown in FIGS. 2A and 2B, the configuration of the outer surface of the wrap 102 is constituted by an involute curve 2 having a base circle 3 of a radius a, whereas, the configuration of the inner surface of the wrap 102 is constituted by an involute curve 4 having the same base circle as the involute curve of the outer configuration and arcs 5 and 6 which have respective radii of R and r. The point 7 of contact between the involute curve 4 and the arc 5 is expressed in terms of an angle $\lambda_i'$ on the base circle 3. Similarly, the imaginary point 8 of contact between the outer involute curve 2 and the arc 5 is expressed in terms of an angle $\lambda_O'$ on the base circle 3. In this case, the angles $\lambda_i'$ and $\lambda_O'$ meet the condition of $\lambda_i' = \lambda_O' + \pi$. The radius R of the arc 5 is roughly determined by $R \approx \epsilon + t/2$, where $\epsilon$ and t represent, respectively, the radius of orbiting of the orbiting scroll member and the thickness of the wrap. Thus, the arc 5 has a radius substantially the same as the width of the groove defined by adjacent turns of the wrap. The arc 6 of the starting end of the wrap contacts the outer involute curve at a point 9 which is expressed by an angle $\lambda_O$ on the base circle 3, and contacts the arc 5 at a point 10. On the other hand, the contour of the groove bottom surface 11 of the wrap is represented by the envelop curve of a circle, the circle of which has a radius R' substantially equal to R and moves along an involute curve 12 having the same base circle as that of the involute curves on the wrap side surfaces. In this embodiment, the condition of $R' \approx R$ is met and the starting point of the involute curve 12 is a point 13 which is expressed by the angle $\lambda_i'$ on the base circle 3. According to the invention, the groove bottom surface 11 is formed at a slight height difference from a first surface 14 which is defined between the side surfaces of adjacent turns of the wrap, as shown in FIG. 3.

Figure 2D:
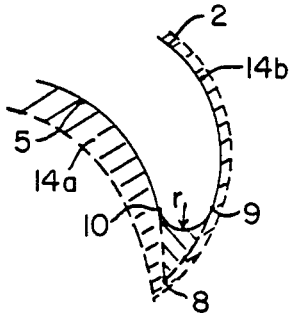

In the embodiment of FIGS. 2A and 2B, the portion which is defined by the points 8, 9, 10 ahead of the wrap shown in FIG. 2B also forms the first surface portion 14. This first surface portion 14 does not impede the movement of the orbiting scroll member 100 because the edge of the projecting end of the wrap is chamfered as at 15. In order to prevent any increase in the leak area due to the chamfering, the height of the step between the wrap side surface and the groove bottom surface is preferably not greater than 1/50 of the height of the wrap height. In the described embodiment, the machining of the wrap groove bottom surface can be conducted simply by using a cutter which has a diameter of $dc=2R'$ and by moving the center of the cutter from the point 13 towards a point 16*b* along the involute curve 12. Thus, the machining does not require the complicated movement of the tool for removing the hatched area 14 shown in FIG. 2. In addition, the risk of machining error can be reduced remarkably because the groove bottom surface can be machined by a single machining cycle. Alternatively, as shown in FIGS. 2C, 2D, the machining can be conducted by selecting a point 16*a* expressed by an angle $\lambda_i=\lambda_O+\pi$ as the center of the cutter, where the angle $\lambda_O$ represents the starting point 9 of the outer involute curve, and moving the cutter towards the point 16*b*. In this case, the first surface of the step is indicated by a hatched area 14*a*.

The step has a very small width of micron order, although it is shown in an exaggerated manner in FIG. 2D. It is to be understood also that, although the hatched portion 14*a* where the first surface is provided seems to be wider than other portions, this is attributable to the fact that the center of machining by the cutter is deviated from the point 13 (FIG. 2A) to the point 16*a*. If the machining is started by using the point 13 as the center of the machining, the first surface portion 14*a* can be formed as a step the width of which is as small as that of a portion 14*a*' (FIG. 2B) where the first surface is also formed. According to the invention, a step of the same width as the portion 14*a*' is formed also on the outer side of the outer involute curve 2, in such a manner as to present a first surface portion 14*b*. According to this method, it is possible to form both the wrap side surfaces and the groove bottom surface independently of each other at high precision.

FIG. 4 shows an enlarged view of a portion of both scroll members, showing particularly the wraps 102 and 202 of both scroll members meshing with each other. The gaps 15*c* between the opposing side surfaces of both wraps 102, 202 and between the axial end of the wrap 202 and the groove bottom surface or second surface 11 of the end plate 101 are extremely small, and oil films are formed in these gaps such as to provide a seal which prevents any leak of a gas from the compression chamber. The corner portion of the groove bottom is provided with a rounded surface 11*a* which is formed when the first surface portion 14*a* and the second surface 11 are machined by a cutting tool having a rounded edge. Therefore, two spaces 15*a* and 15*b* are formed at the corner, when the wrap 202 of the stationary scroll member is brought into meshing engagement with the wrap 102. If there is any leak of the gas through the gap 15*c*, the pressure of the gas is decreased when it passes through the spaces 15*a* and 15*b*, thus causing so-called labyrinth effect.

Although the illustrated embodiment has only two spaces 15*a* and 15*b*, this is not exclusive and each corner portion may be machined such that it has three or more spaces, as apparent from FIG. 4.

FIG. 5 is a plan view of the whole portion of the orbiting scroll member 100 after the machining of the groove bottom surface has been completed over the entire area which necessitates the machining. The machining is made down to a point 23 which is expressed by $-\pi$ with respect to the angle on the base circle representing the terminating end 22 of the wrap 102. In FIG. 5, the first surface portions 14, 14*a* and 14*b* have been omitted, and the detail of these first surface portions is shown in FIG. 6 which is a sectional view taken along the line VI—VI in FIG. 5. A sliding surface 21 is formed on the orbiting scroll member 100, which makes a sliding contact with a sliding surface 205 of the stationary scroll member 200. The level of the sliding surface 21 is lower than the first surface portions 14*a*, 14*b* and, hence, closer to the second surface 11 than the first surface portions 14*a*, 14*b*. The sliding surface 21 on the orbiting scroll member 100 can be formed easily by machining provided that the inside diameter D of the sliding surface 21 is selected to be smaller than a value $D_1-2\epsilon$, where $D_1$ represents the inside diameter of the outer wall of the stationary scroll member 200 shown in FIG. 7 while $\epsilon$ represents the radius of orbiting movement, and to be greater than the value which is double the radius $R_2$ of the outer contour of the wrap terminating end of the orbiting scroll member 100 shown in FIG. 5, i.e., such that the following condition is met:

$$D_1-2\epsilon>D>2R_2.$$

The groove bottom surface 31 of the wrap 202 of the stationary scroll member 200 has the same configuration as that of the orbiting scroll member 100. Namely, as shown in FIGS. 7 and 8, the groove bottom surface 31 is formed in such a manner that it is recessed from first surface portions 34*a*, 34*b* adjacent the wrap and a surface 32 which forms a wall outside the wrap 202, whereas the axial end surface of the wrap 202 and the sliding surface 205 are formed in the same plane. The shape of each chamfer 35 on the axial end of the wrap 202 may have an arcuate form coinciding with the shape of each corner of the groove bottom of the wrap 102 of the opposing scroll member 100.

In the machining, the side surfaces of each wrap 102, 202 are machined first and then the second surface 11 or 31 is formed in such a manner as to leave the first surface portions 14*a* and 14*b*, or 34*a* and 34*b*. The machining of the sliding surface 21 of the orbiting scroll member 100 shown in FIG. 6 is preferably conducted such that it is formed at a level close to that of the second surface 11 as much as possible.

According to the invention, since the configuration of the side surfaces of the wrap 102, 202 and the configuration of the groove bottom surface of the end plate 101, 201 are different from each other and are machined independently of each other, the machining time can be shortened and the machining precision can be enhanced thereby reducing the rate of leak of the gas. In addition, the strength of the base portion of each wrap can be increased by virtue of the steps formed along the base of the wrap.

What is claimed is:

1. A scroll-type fluid machine comprising an orbiting scroll member and a stationary scroll member, each of said scroll members having an end plate and a spiral wrap protruding upright therefrom, said scroll members being assembled together with their wraps meshing with each other, said orbiting scroll member being movable to execute an orbiting motion so that closed spaces defined by the wraps and end plates of both scroll members are progressively moved towards the center thereof while decreasing their volumes in accordance with the orbiting movement of said orbiting scroll member, wherein steps are formed at respective corners of a groove bottom between adjacent turns of the wrap of each scroll member so that said groove bottom is formed in a different configuration from that defined between adjacent turns of the wrap of each scroll member, and edges of a projecting end of the wrap of each scroll member facing said steps are chamfered to avoid a collisions of said projecting wrap end with said steps.

2. A scroll-type fluid machine comprising an orbiting scroll member and a stationary scroll member, each of said scroll members having an end plate and a spiral wrap protruding upright therefrom, said scroll members being assembled together with their wraps meshing with each other, said orbiting scroll member being movable to execute an orbiting motion so that closed spaces defined by the wraps and end plates of both scroll members are progressively moved towards the center thereof while decreasing their volumes in accordance with the orbiting movement of said orbiting scroll member, wherein the improvement comprises that edges of the projecting end of the wrap of each scroll member are chamfered, and that steps are formed in conformity with a configuration of each spiral wrap on respective corners of a groove bottom between adjacent turns of the wrap, said chamfered edges of the projecting end of the wrap of each scroll member facing said steps on said groove bottom on the opposing scroll member, respectively, and wherein each of said steps is formed by at least two arcuate portions.

3. A scroll-type fluid machine according to claim 1, wherein each of said steps is formed by at least two arcuate portions.

* * * * *